US005155876A

United States Patent [19]

Whitaker

[11] Patent Number: 5,155,876

[45] Date of Patent: Oct. 20, 1992

[54] INTEGRATED SOUND BAFFLE

[75] Inventor: Emert R. Whitaker, Siloam Springs, Ark.

[73] Assignee: Clarke Industries, Inc., St. Louis, Mo.

[21] Appl. No.: 783,220

[22] Filed: Oct. 28, 1991

[51] Int. Cl.[5] ..... A47L 11/30

[52] U.S. Cl. ..... 15/320; 15/326; 15/353; 55/276; 417/312

[58] Field of Search ..... 15/320, 326, 321; 55/276; 417/312

[56] References Cited

U.S. PATENT DOCUMENTS

| | | | |
|---|---|---|---|
| 3,466,696 | 9/1969 | Grellsson | 15/327 |
| 3,831,223 | 8/1974 | Colt et al. | 15/326 X |
| 4,330,899 | 5/1982 | Miller et al. | 15/326 |
| 4,361,928 | 12/1982 | Schulz | 15/326 |
| 4,475,264 | 10/1984 | Schulz | 15/326 X |
| 4,533,370 | 8/1985 | Ikezaki et al. | 55/276 |
| 4,617,034 | 10/1986 | Ikezaki et al. | 55/276 |
| 4,651,380 | 3/1987 | Ogden | 15/326 X |
| 4,786,299 | 11/1988 | DeMarco | 55/276 |
| 4,970,753 | 11/1990 | Herron, Jr. | 15/326 |

OTHER PUBLICATIONS

Clarke Industries, Inc. advertising brochures for Family of Compact Automatics.

*Primary Examiner*—Chris K. Moore

*Attorney, Agent, or Firm*—Herzog, Crebs & McGhee

[57] ABSTRACT

The floor cleaning machine utilizes an integrated sound baffle to reduce the noise level of the machine during operation. The floor cleaning machine relies upon a vacuum motor to create a negative pressure in a recovery tank for operation of a vacuum squeegee. The integrated sound baffle is a hollow u-shaped body having an interior passageway through which the exhaust from the vacuum motor is directed. The noisy exhaust is required to turn four 90° corners as it passes through the interior passageway of the baffle which reduces the noise level of the exhaust. The moist exhaust is also isolated from the brush motor and the vacuum motor while it passes through the hollow baffle. The baffle is an integrated component of the apparatus and is a load bearing member for the solution tank and the recovery tank. The baffle can be roto-molded using conventional techniques with a thermoplastic such as HDPE.

16 Claims, 4 Drawing Sheets

INTEGRATED SOUND BAFFLE

BACKGROUND OF THE INVENTION

1. Field of the Invention

The integrated sound baffle reduces the noise level of a floor cleaning machine while in operation. This floor cleaning machine includes a vacuum motor which creates a negative pressure in a recovery tank to create suction in a vacuum squeegee. The exhaust from this vacuum motor is rather noisy and is typically laden with moisture. The integrated sound baffle reduces the noise level of the exhaust from this vacuum motor and isolates the moisture from the electric motors and other electronic components in this floor cleaning machine.

2. Description of the Prior Art

U.S. Pat. Nos. 4,533,370 and 4,617,034 describe a compact electric vacuum cleaner including an air rectifying duct installed on the external surface of the cleaner to reduce the noise level of the exhaust during operation of the vacuum cleaner. This apparatus includes acoustical noise suppression material which encircles an electric air blower and further includes a noise absorber and noise shielding material placed on the inside of the air rectifying duct.

The addition of this acoustical sound absorbing material increases the manufacturing cost of the vacuum cleaner described in the aforementioned patents. The flow path of the exhaust in this compact electric vacuum cleaner passes through the air rectifying duct and into a lower housing. This multi-piece design is apparently intended to further reduce the level of exhaust noise. The rectifying duct is a non-integral member and is added to the exterior of this vacuum. This duct is not intended to be a substantial load bearing component in the overall design of the compact electric vacuum cleaner.

Several different mufflers and other types of sound attenuation apparatus are disclosed in other patents which are included in the Information Disclosure Statement filed concurrently herewith.

Clarke Industries, Inc., the assignee of the present invention, has previously manufactured several floor cleaning machines which are similar to the present invention. Most of these machines manufactured by Clarke do not utilize any acoustical sound absorbing material or other means to reduce the noise level of the exhaust from the vacuum motor. When the present invention is added to these floor cleaning machines manufactured by Clarke Industries, the overall noise level during operation is reduced.

Clarke Industries has also manufactured a floor cleaning machine similar to the present invention which does utilizes acoustical sound absorbing material and a muffler mounted in the exhaust conduit of the vacuum motor. When the present invention is used in lieu of this prior art sound dampening system, there is still an overall reduction in the noise level of the floor cleaning machine during operation. In addition, the present invention is more economical and easier to manufacture than prior art sound dampening systems

SUMMARY OF THE INVENTION

The integrated sound baffle includes a roto-molded hollow u-shaped body. This body is easy and inexpensive to manufacture and does not require the addition of acoustical sound absorbing material to operate efficiently; however, the addition of such material may further enhance the sound absorbing qualities of the apparatus. The hollow u-shaped body is integrated into the overall design of the floor cleaning machine and is a load bearing member for the recovery tank and the solution tank which are mounted on top thereof.

Compared with standard floor cleaning machines manufactured by Clarke Industries, the present design is much quieter and is more economical to manufacture. Compared to floor cleaning machines manufactured by Clarke Industries which do include a sound attenuation system, the present design achieves greater noise reduction and is more economical to manufacture.

The integrated sound baffle enhances the useful life of this floor cleaning machine because moist exhaust air from the vacuum motor is contained in a plastic cavity which isolates it from the brush motor, the vacuum motor and other electronic components.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
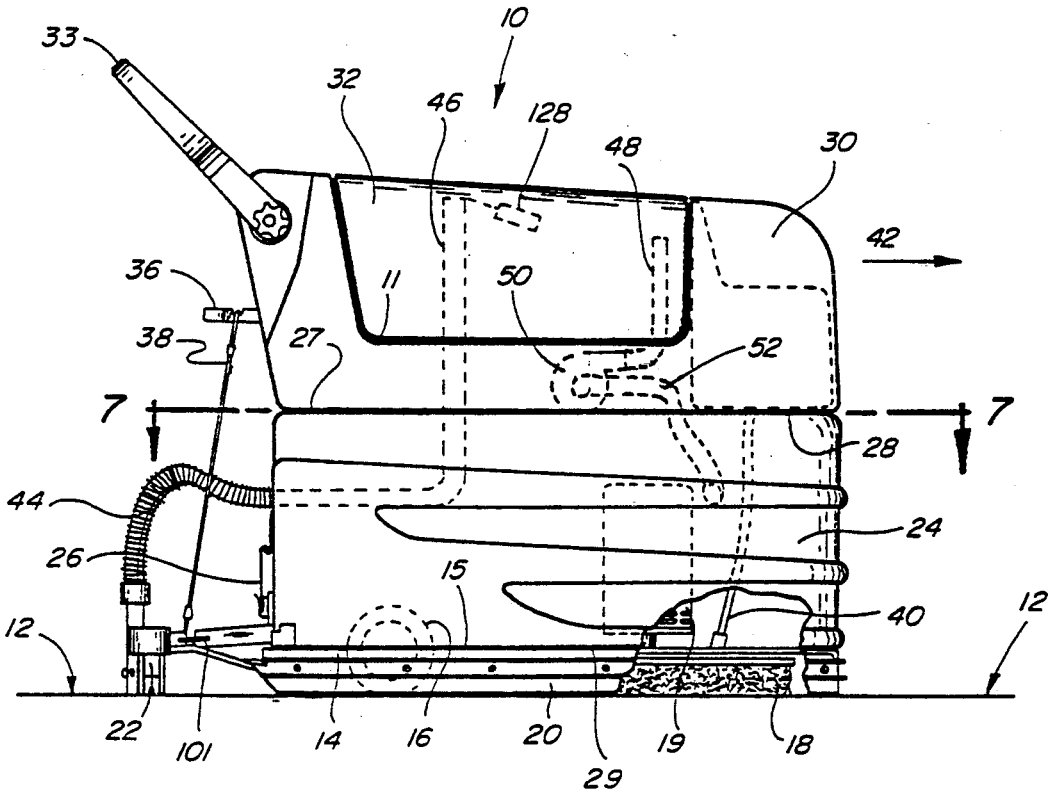
FIG. 1 is a side elevation view of the floor cleaning machine with a cut away view of the circular cleaning pad and brush motor.

In FIG. 1, the numeral 10 generally identifies the floor cleaning machine which operates on the floor 12. The present apparatus is designed primarily for use on hard surface floors such as linoleum and concrete; however, the integrated sound baffle could be used on other types of floor cleaning machines which need to reduce the sound level of the exhaust from a vacuum motor.

The floor cleaning machine 10 includes a chassis 14 and a plurality of wheels, one of which 16 is shown in phantom in this view. The top surface 15 of the chassis 14 is generally coplanar to the floor 12. The floor cleaning machine 10 utilizes a circular disc 18 which is in contact with the floor 12. The circular disc 18 can be an integrated circular plastic pad or a circular disc shaped brush, the designs of which are well known to those skilled in the art. The circular disc 18 is rotated by a brush motor 19 which is mounted on the chassis 14 to scrub the floor 12. To contain the liquids that are applied to the circular disc 18 and the floor 12, a skirt 20 encircles the bottom of the chassis 14.

At the rear of the floor cleaning machine 10 is a double blade vacuum squeegee or shoe 22 which sucks dirty solution 123 from the floor as the floor cleaning machine 10 moves forward. The construction and arrangement of the vacuum squeegee 22 is well known to those skilled in the art.

The integrated sound baffle 24 is mounted by a hinge 27 to the chassis 14. The integrated sound baffle 24 can be tilted forward to facilitate access to the internal components of the floor cleaning machine 10 as better seen in FIG. 2. When the integrated sound baffle 24 is tilted closed, as shown in FIG. 1, it is locked in position by a left latch 25 and a right latch 26. When closed the bottom surface 29 of the sound baffle 24 rests on the top surface 15 of the chassis 14.

The top surface 28 of the integrated sound baffle 24 supports the solution tank 30 and the recovery tank 32. The solution tank 30 holds a liquid cleaning solution and the recovery tank 32 hold dirty solution.

The solution tank 30 is a roto-molded hollow body typically formed from High Density Polyethylene (HDPE). However, other thermoplastics may be suitable for this purpose. A cradle or depression 11 is found in the center of the solution tank 30 to receive and support the recovery tank 32.

The recovery tank 32 is a roto-molded hollow body typically formed from HDPE. However, other thermoplastics may be suitable for this purpose. Those skilled in the art will recognize that the shape and relative position of the solution tank 30 and the recovery tank 32 is a matter of manufacturing convenience. Other shapes and designs for the solution tank and recovery tank are within the scope of this invention.

The sound baffle 24 is an integral part of the apparatus and is a load bearing member. The solution tank 30, the recovery tank 32, the control panel 35 and the handle 33 together weigh approximately 50 pounds dry (without cleaning solution) and approximately 200 pounds wet (with cleaning solution therein); this load is supported by the sound baffle 24. The bottom surface 27 of the solution tank 30 engages the top surface 28 of the baffle 24.

A handle 33 is adjustably mounted on a portion of the solution tank 30. The operator of the floor cleaning machine 10 grabs the handle 33 and manually pushes the machine 10 forward. In an alternative embodiment, the floor cleaning machine can be self propelled by the addition of a traverse motor. The floor cleaning machines can be either battery powered, which requires recharging, or the machines can be equipped with a long extension cord to plug into an AC power source.

However, in the manually operated versions which contain onboard batteries, it is important to keep the machine as light as possible to make it easier for the operator to push. Without any liquids therein the floor cleaning machine 10, which is pushed by the operator, weights approximately 400 pounds including batteries. The addition of cleaning solution adds about 150 pounds to the weight of the machine for a total of approximately 550 pounds.

Mounted on the rear of the solution tank 30 is a lever 36 and a support cable 38 which supports the load of the vacuum squeegee or shoe 22 during operation thereof.

The floor cleaning machine 10 operates as follows. A liquid which is generically referred to as a cleaning solution is placed in the hollow solution tank 30. The operator actuates the pedal 101 which lowers the circular disc 18 into contact with the floor 12. The operator actuates the control switch 43 which turns on the brush motor 19 which causes the circular disc 18 to rotate while it is in contact with the floor 12. The operator actuates the control switch 41 on the control panel 35 and turns on the vacuum motor 50. The cleaning solution is dispensed from the solution tank 30 through a flexible hose 40 which passes through an aperture 120 in the chassis 14 and is dripped on top of the circular disc 18 and thereafter to the floor 12.

The cleaning solution is gravity fed through a valve, not shown in the drawings. The valve is controlled by a control means knob 39 on the control panel 35. The more the valve is opened the greater the rate of flow of cleaning solution from the solution tank 30 through the flexible hose 40 to the circular disc 18. As the cleaning solution drips through the disc it contacts the floor for cleaning, scrubbing, polishing or stripping.

The operator then pushes the floor cleaning machine 10 forward as shown by the direction arrow 42. On those machines equipped with a traverse motor, the operator actuates the traverse motor which causes the machine to move across the floor. As the floor cleaning machine 10 moves forward the vacuum squeegee 22 sucks up the dirty solution 123 from the floor. This solution is then transferred via a flexible conduit 44 to the hollow recovery tank 32 where it is stored until discharge. The flexible conduit 44 connects to a vertical stand pipe 46, shown in phantom, which is rigidly mounted in the recovery tank 32. A second vertical stand pipe 48, shown in phantom, is also rigidly mounted in a vertical position in the recovery tank 32. The second stand pipe 48 connects to the suction side of a vacuum motor 50, shown in phantom, which maintains a negative pressure in the hollow recovery tank 32. The negative pressure is transferred through the first vertical stand pipe 46 and the flexible conduit 44 to the vacuum squeegee 22 to create suction and thus remove dirty solution from the floor. A float shut-off 128 is positioned inside the recovery tank 32. When the fluid level reaches a predetermined upper lever the float 50 shut-off turns the vacuum motor off.

The exhaust outlet of the vacuum motor 50 connects to a flexible conduit 52, shown in phantom, which connects to the inlet 54 in the integrated sound baffle 24. The vacuum motor 50 is typically a 1 or 2 HP universal type motor, which means it will run on AC or DC. However, other motors may also be suitable for this application. The exhaust from the vacuum motor 50 enters a passageway 56 in the hollow u-shaped body of the integrated sound baffle 24. The exhaust passes through the passageway 56 and then exits through the outlet 58 in the bottom 29 of the integrated sound baffle 24. The inlet 54 is positioned in one leg of the u-shaped body and the outlet 58 is positioned in the opposite leg of the u-shaped body. The interior passageway 56 requires the exhaust to turn four 90° corners from the inlet 54 to the outlet 58 which tends to lower the noise level of the exhaust.

Figure 2:
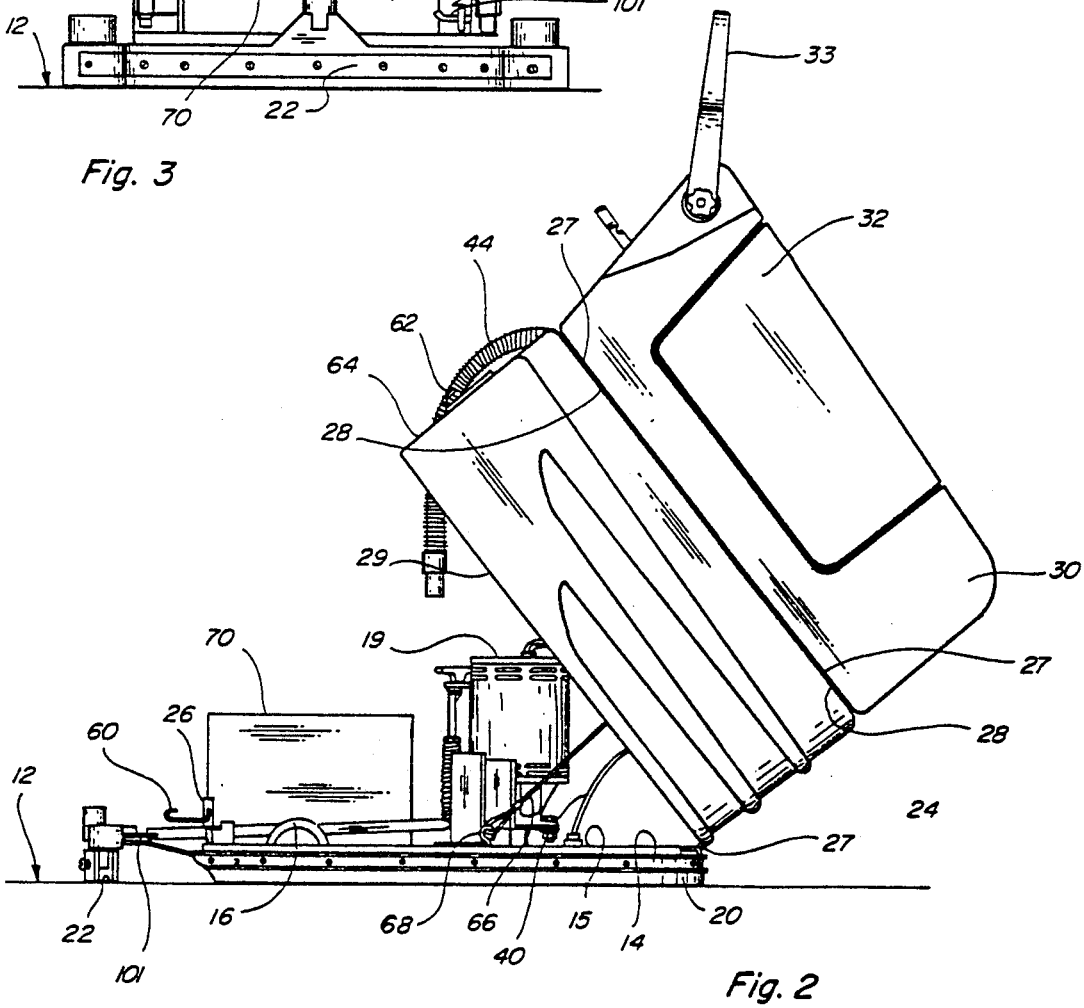
FIG. 2 is a side elevation view of the floor cleaning machine. The integrated sound baffle is hinge mounted to the chassis and is shown in the open position in this Figure exposing the brush motor, the rear wheels and the battery compartment.

In FIG. 2, the latches 25 and 26 have been opened, the flexible conduit 44 has been disconnected from the vacuum squeegee 22 and the support cable 38 has been disconnected from the lever 36 allowing the integrated sound baffle 24 to be tilted forward on the hinge 27 which is connected to the chassis 14. Opening the machines as shown in this Figure, facilitates maintenance or repair on the brush motor 19, the vacuum motor 50, or any of the electronic components in the apparatus.

When the integrated sound baffle 24 is tilted back down the bottom surface 29 of the integrated sound baffle 24 contacts the top surface 15 of the chassis 14. The load from the solution tank 30 and the recovery tank 32 is therefore transferred through the integrated sound baffle 24 to the chassis 14 and ultimately to the wheels and thence to the floor 12.

The latch 26 includes a conventional buckle 60 which engages a catch 62 which is mounted on the rear 64 of the integrated sound baffle 24.

A restraining wire 66 restrains the integrated sound baffle 24 from tilting any further forward than shown in this drawing. One end of the restraining wire 66 is connected to the inside surface 25 of the sound baffle 24 and the other end is connected to an eye 68 mounted in the chassis 14.

Also mounted on the chassis 14 is a battery box 70. The brush motor 19 is typically powered by two lead acid 12 volt batteries 150 and 151 wired in series which have a 95 or 100 amp. hour rating. Other types of batteries may also be suitable for this application. These batteries, of course, can be recharged and electrical connectors 45 run from the batteries 150 and 151 to a plug 47 on the exterior of the machine to facilitate recharging. Operational time for the brush motor on one battery charge typically varies from two to four hours, depending on the type of floor surface, type and amount of cleaning solution and the type of circular disc 18 then in use.

The brush motor 19 can be of several different designs. On the battery powered models, a ¾ HP permanent magnet 24 Volt DC motor is typically used. It typically has an integral gear box positioned between the motor and the circular disc 18. On the electric models, a ¾ HP permanent magnet 120 Volt DC motor is used for U.S. Machines and a 220 Volt DC motor is used for European machines. Rectifiers, not shown in the drawings, are used to convert the alternating current to direct current to drive these brush motors. However, other motors may be useful in these different applications. Other electronic components, such as timers, circuit breakers and relays, not shown in the drawings, are mounted underneath the solution tank 30.

Figure 3:
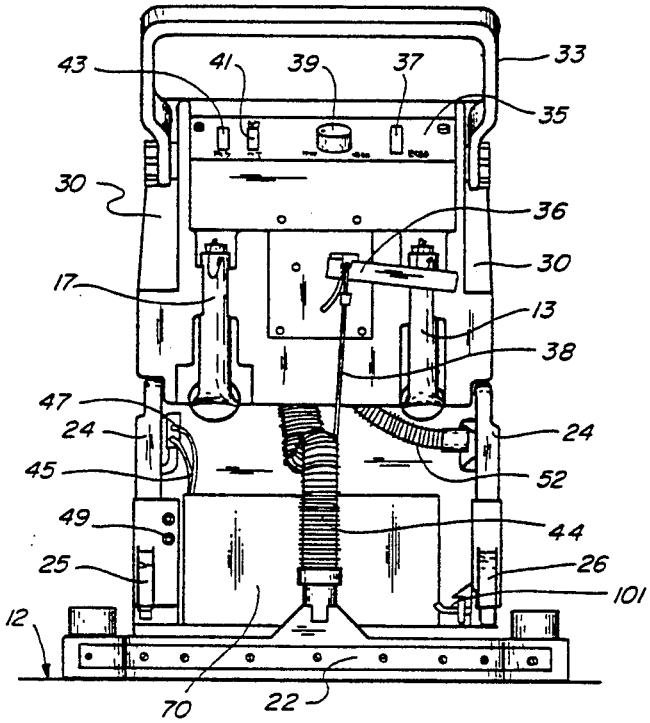
FIG. 3 is a rear elevation view of the floor cleaning machine.

In FIG. 3, the rear of the machine 10 is shown in elevation view. A drain, not shown, is positioned in the bottom of the recovery tank 32 which connects to a flexible drain hose 13 to facilitate draining the tank 32. The flexible drain hose 13 is normally held in an upright position as shown in the drawing; however, when the operator wishes to drain the recovery tank 32, the drain hose 13 can be repositioned in a downward direction to simplify draining the tank 32. A drain, not shown, is positioned in the bottom of the solution tank 30 which connects to a flexible drain hose 17 to facilitate draining the tank 30. Likewise, the flexible drain hose 17 is normally held in an upright position; however, it can also be repositioned in a downward direction to simplify draining the solution tank 30.

The control panel 35 has various control means mounted thereon. The on/off switch 43 for the brush motor 19 is positioned to the left of the panel 35. The on/off switch 41 for the vacuum motor 50 is positioned adjacent the switch 43. A control knob 39 is positioned in the middle of the panel 35 and controls the valve, not shown in the drawings, which meters the amount of cleaning solution which is dispensed from the solution tank 30 to the circular disc 18. In machines with a traverse motor, an on/off key switch and a speed switch to control the speed of the traverse motor are added to the panel 35.

The batteries 150 and 151 are positioned in the battery box 70. Connectors 45 run from these batteries to a plug 47 which is used for recharging. A recharger is sold with battery powered machines. A pair of reset buttons 49 for circuit breakers, not shown, are positioned on a plate to the rear of the baffle 24. The purpose of the circuit breakers is to control amperage to the brush motor 19 and vacuum motor 50. On traverse models an additional circuit breaker is added to control amperage to the traverse motor 152. A battery meter 37 is positioned on the control panel 35 to let the operator know when it is necessary to recharge the batteries.

Figure 4:
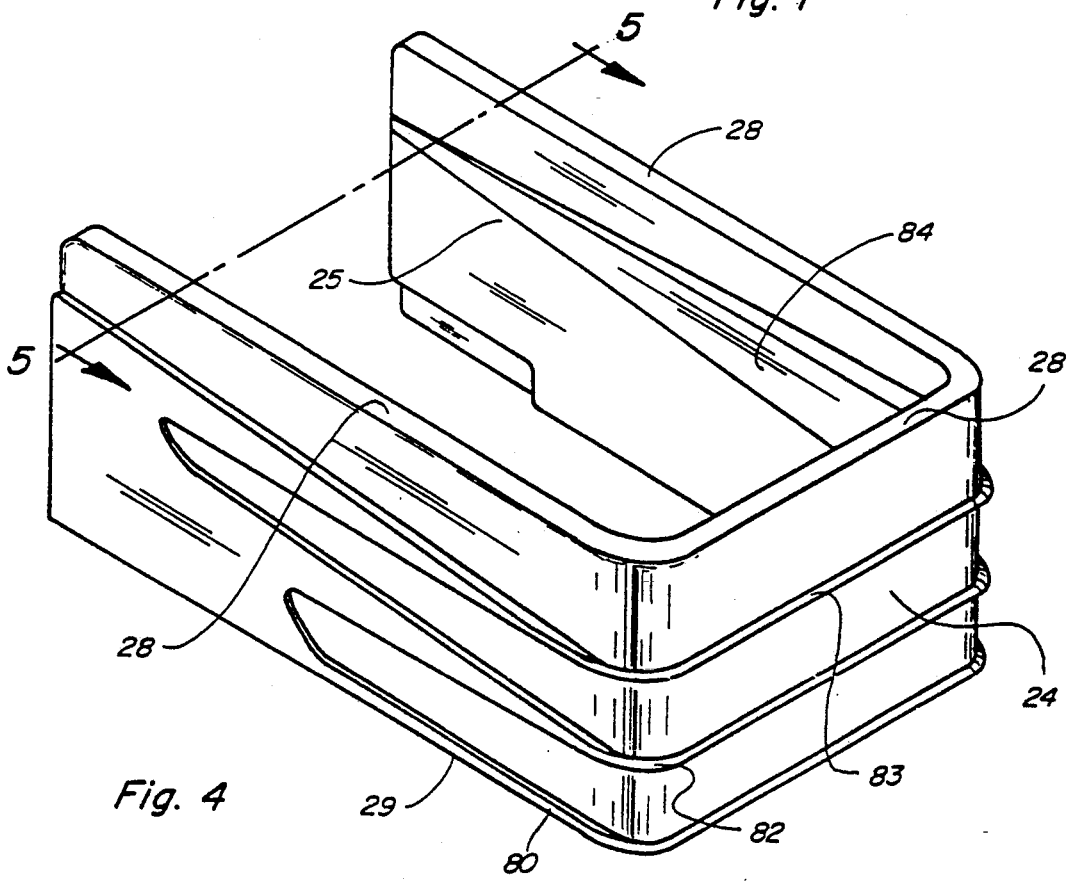
FIG. 4 is an enlarged perspective view of the integrated sound baffle.

In FIG. 4 an enlarged view of the integrated sound baffle 24 is shown in perspective. The top surface 28 of the integrated sound baffle 24 is relatively flat and is coplanar with the bottom surface 29 of the integrated sound baffle. A plurality of ridges 80, 82 and 83 are formed in the outer surface of the integrated sound baffle 24 to provide strength and structural integrity to the baffle 24 and also for aesthetic purposes. Interior ridges 84 are formed on the inside 25 of the integrated sound baffle 24 to strengthen and add rigidity.

The integrated sound baffle 24 is roto-molded using conventional techniques well known to those skilled in the art. Applicant recommends that the sound baffle be molded from HDPE; however, other thermoplastics may be suitable for this application.

The recovery tank 32 rests in a depression 11 of the solution tank 30 which rests on the top surface 28 of the integrated sound baffle 24 which fully supports the load of both tanks. This load is then transferred through the vertical sides of the integrated sound baffle 24 to the top surface 15 of the chassis 14. The load is then transferred through the chassis to the plurality of wheels and thereafter to the floor 12. The baffle 24 does not require acoustical sound attenuating material to be positioned on the inside surface 25 of the hollow u-shaped integrated sound baffle 24 or in the interior passageway 56 to operate efficiently. However, the addition of such material may further enhance the sound absorbing qualities of the apparatus.

Figure 5:
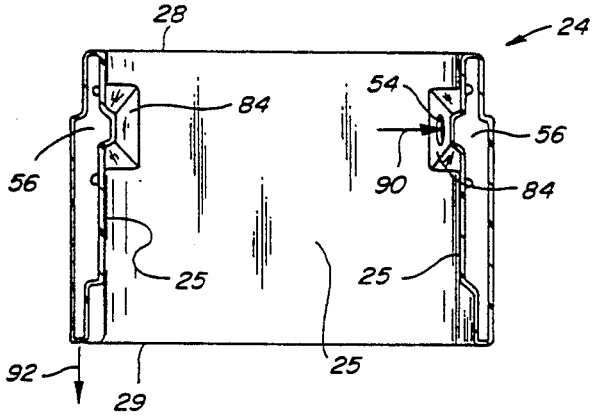
FIG. 5 is a section view of the integrated sound baffle along the line 5—5 of FIG. 4.

FIG. 5 is a section view of the integrated sound baffle 24 along the line 5—5 of FIG. 4. The exhaust from the vacuum motor 50 enters the inlet port 54 as shown by the flow arrow 90 in the drawing. The exhaust then moves through the interior passageway 56 in the hollow u-shaped baffle 24. The exhaust exits the interior passageway 56 as shown by the flow arrow 92. The upper surface 28 of the baffle 24 supports the solution tank 30 and the recovery tank 32. The bottom surface 29 of the baffle 24 engages the upper surface 15 of the chassis 14. The vertical walls of the hollow u-shaped baffle 24 are designed to be load bearing members and an integral part of the floor cleaning machine 10.

Figure 6:
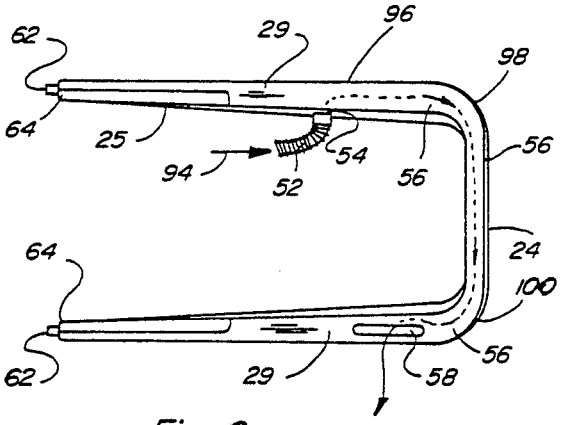
FIG. 6 is a bottom plane view of the integrated sound baffle.

FIG. 6 is a bottom plan view of the baffle 24. A portion of the flexible conduit 52 is connected to the inlet 54. The exhaust from the vacuum motor 50 passes through the flexible conduit 52 as shown by the flow arrow 94. The exhaust immediately hits an interior side 96 of the baffle 24 as shown in the drawing. The exhaust and the sound must therefore turn a sharp 90° corner as it moves through the passageway 56. The exhaust and sound then encounter the front right corner 98 of the baffle 24 and are forced to turn another 90° corner. The exhaust and sound continues to pass through the passageway 56 and encounters the front left corner 100 of the baffle 24. The sound and noise are then forced to turn another 90° corner. The exhaust then continues through the passageway 56 and must turn another 90° corner to exit through the outlet port 58. In summary, the exhaust and sound must turn four 90° corners from the inlet 54 to the outlet 58 in the integrated sound baffle 24. This repeated change of direction tends to reduce the noise level in the exhaust from the vacuum motor 50. In addition, the passageway 56 isolates the moist exhaust from the brush motor 19, the vacuum motor 50 and other electronic components in the apparatus.

Figure 7:
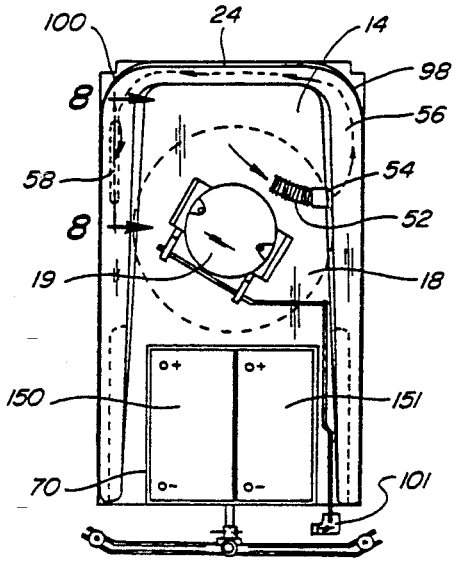
FIG. 7 is a section view of the floor cleaning machine along the line 7—7 of FIG. 1.

FIG. 7 is a section view of the floor cleaning machine 10. A portion of the flexible conduit 52 is shown in this drawing and is mounted in the inlet 54 of the baffle 24. The brush motor 19 is mounted on the chassis 14 above the circular disc 18 which is shown in phantom. The battery box 70 is positioned to the rear of the chassis and holds batteries 150 and 151.

Exhaust and noise from the vacuum motor 50 pass through the flexible conduit 52 as shown by the flow arrow 102. The exhaust and noise then pass through the passageway 56 in the hollow interior of the baffle 24. The exhaust and noise are forced to turn around the front right corner 98 of the baffle 24 and again are forced to turn around the front left corner 100 of the baffle 24 before exiting the outlet 58 in the bottom surface 29 of the baffle 24. The pedal 101 is actuated by the operator to raise the circular disc 18 out of contact with the floor 12 and to lower the disc 18 into contact with the floor 12. The structure and operation of this elevation mechanism is well known to those skilled in the art. This elevation mechanism is needed to allow the machine 10 to be easily pushed over door sills and other obstructions.

Figure 8:
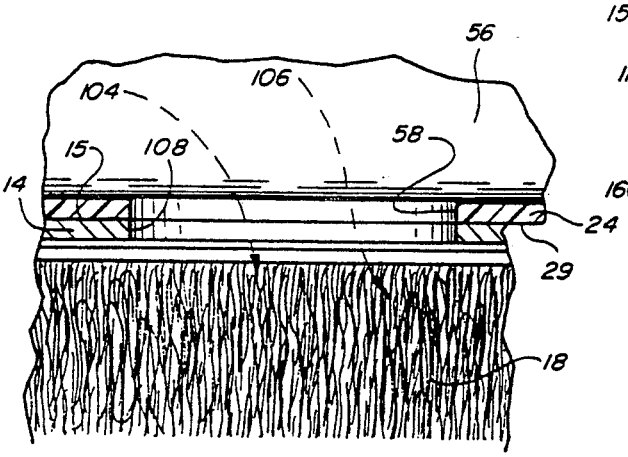
FIG. 8 is an enlarged section view of the integrated sound baffle, the chassis and a brush along line 8—8 of FIG. 7.

FIG. 8 is an enlargement of the outlet 58 in the sound baffle 24. Exhaust from the vacuum motor passes through the outlet 58 as shown by the flow arrows 104 and 106. The bottom surface 29 of the baffle 24 engages the top surface 15 of the chassis 14 supporting the load of the solution tank 30 and the recovery tank 32. An aperture 108 is formed in the chassis 14 and is axially aligned with the outlet 58 of the baffle 24. This axially alignment of the outlet 58 and the aperture 108 allows the exhaust to exit the baffle 24, pass through the chassis 14 and be discharged underneath the machine in the proximity of the circular disc 18. This arrangement isolates the moist exhaust air from the brush motor 19, the vacuum motor 50 and other electronic components.

Figure 9:
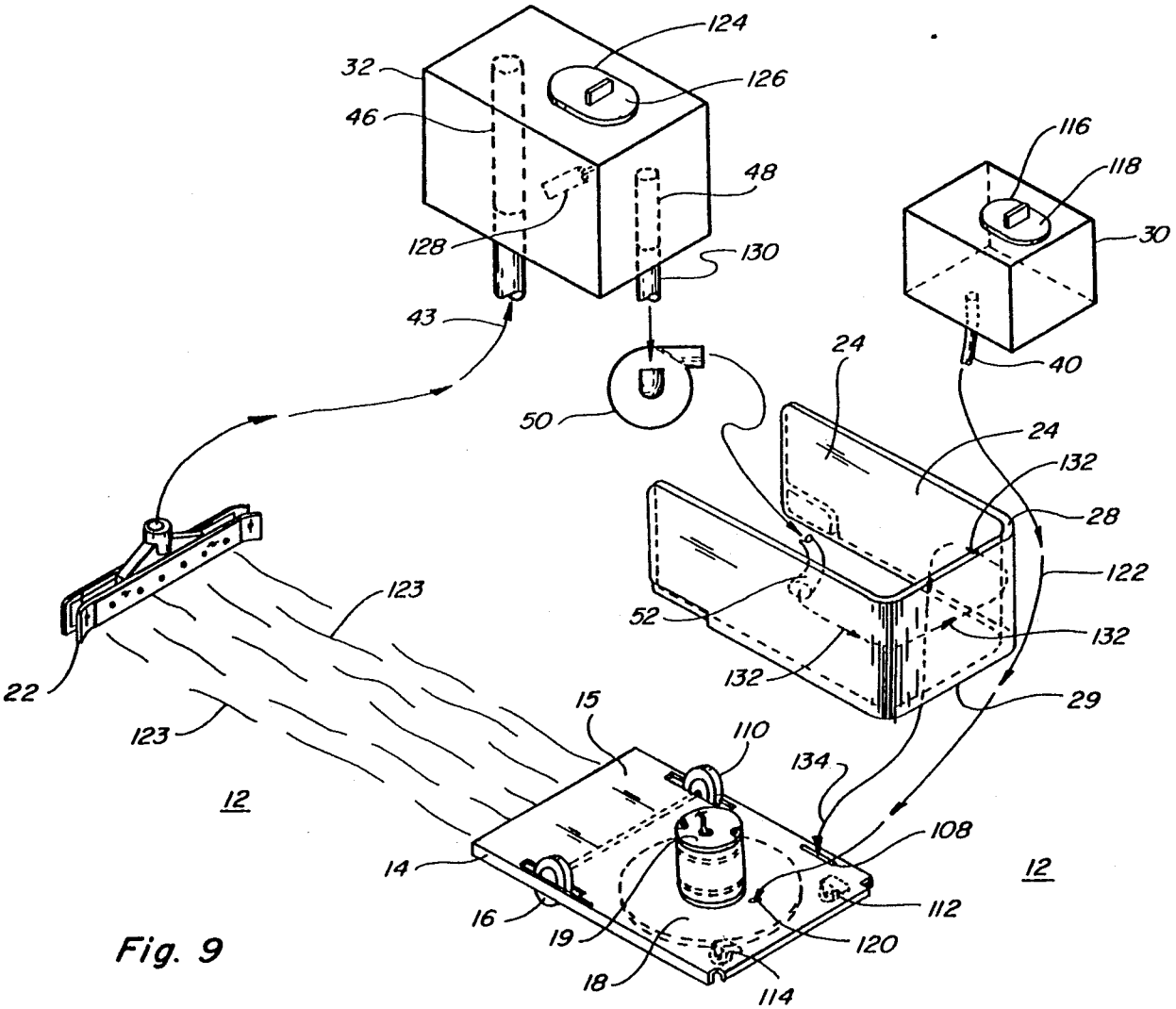
FIG. 9 is a diagrammatic drawing of the primary components of this floor cleaning machine including, the fluid flow path and the exhaust flow path.

FIG. 9 is a diagrammatic view of the fluid flow path and the exhaust flow path in the floor cleaning machine 10. The chassis 14 has a left rear wheel 110 and a right rear wheel 16 when viewed from the operator's perspective. It also has a front left wheel 112 and a front right wheel 114, all of which engage the floor 12.

A brush motor 19 is mounted on the chassis 14. The brush motor 19 causes the circular disc 18 shown in phantom to rotate at speeds up to approximately 250 rpm. The circular disc 18 can be used to scrub the floor with a wet cleaning solution, it can be used to strip wax from the floor or it can be used to polish the floor with a wet polish solution. These various liquids are generically referred to as cleaning solution and are stored in the solution tank 30. These liquids include, but are not limited to water, water plus a cleaning agent, water plus a stripping agent, or water plus wax.

An inlet port 116 is formed in the top of the solution tank 30 and receives a cap 118. In order to add cleaning solution to the tank 30, the operator removes the cap 118 and pours it through the inlet port 116. The cleaning solution is then metered through a valve, not shown. The cleaning solution passes through a flexible hose 40 which is positioned in an aperture 120 in the chassis 14.

The cleaning solution flows from the solution tank 30 to the circular pad 18 as shown by the flow arrow 122. The spinning circular disc then scrubs the floor 12 with the cleaning solution which is then converted to dirty solution 123. As the operator pushes the floor cleaning machine 10 forward, the dirty solution, as indicated by the lines 122, is sucked up from the floor by the vacuum squeegee or shoe 22. The dirty solution then passes through the flexible conduit 44 as shown by the flow arrow 43 through the vertical stand pipe 46 and into the recovery tank 32.

Like the solution tank 30, the recovery tank 32 has in inlet port 124 which is tightly sealed with a cap 126. The recovery tank 32 can be manually accessed and cleaned through the inlet port 124 after the cap 126 has been removed.

A float 128 is positioned inside the recover tank 32 and is designed to automatically shut off the vacuum motor 50 when the liquid level in the recovery tank 32 rises to a designated upper level. When the float 128 shuts off the vacuum motor 50, the operator must then drain the recovery tank 32 which is typically accomplished using the flexible drain pipe 13. The suction side of the vacuum motor 50 is connected via a flexible conduit 130 to a vertical stand pipe 48 mounted in the recovery tank 32. The vacuum motor 50 pulls a negative pressure inside the recovery tank 32 which causes suction through the vertical stand pipe 46 and the flexible conduit 44 thus allowing the vacuum squeegee 22 to suck dirty solution 123 from the floor 12.

The pressure side of the vacuum motor 50 is connected by a flexible conduit 52 to the inlet 54 of the baffle 24. The exhaust and noise from the vacuum motor 50 pass through the passageway 56 as shown by the flow arrows 132, shown in phantom. The exhaust and noise exits the baffle 24 through the outlet 58 which is axially aligned with the aperture 108 in the chassis 14. The moist exhaust is discharged underneath the chassis 14 as shown by the flow arrow 134. At all times the moist exhaust from the vacuum motor 50 is contained within the hollow baffle 24 and is not exposed to the brush motor 19, the vacuum motor 50 or the other electronic components of the floor cleaning machine 10.

In the past, Clarke Industries, Inc. has manufactured two different models of a similar floor cleaning machine, i.e. the 1700B (battery operated) and the 1700E (electrically operated). The 1700B was manufactured for the United States market and the European market. "B" machines had rechargeable batteries, on board, as shown in FIG. 7.

The battery powered European version had acoustical sound absorbing material positioned therein and a simple muffler was positioned in-line in the flexible conduit connected to the pressure side of the vacuum motor. The United States battery powered version had no muffler or sound absorbing material placed therein.

In the past, the 1700E was manufactured by Clarke Industries for the United States and European market. These machines came with long extension cords and were plugged into a wall outlet during operation . They did not have on-board batteries. Neither of these E models used a muffler or sound absorbing material.

When the present invention is applied to the aforementioned prior art machines, the operational noise is reduced as shown in Table 1. when the present invention is applied to European battery powered machines in lieu of the prior art sound absorbing system the new machine is still quieter than the prior art version.

TABLE 1

| | | Amt. of Noise Reduction in dB's |
|---|---|---|
| | Standard Models | |
| 1. | 1700E European version | |
| | Prior art | 88.0 |
| | Present Invention | 79.5 |
| | | 8.5 |
| 2. | 1700E U.S. Version | |
| | Prior art | 88.0 |
| | Present Invention | 83.5 |
| | | 4.5 |
| 3. | 1700B U.S. Version | |
| | Prior Art | 73.7 |
| | Present Invention | 69.3 |
| | | 4.4 |
| | Special Sound Attenuated Model | |
| 4. | 1700B European version | |
| | Prior art | 71.5 |
| | Present Invention | 69.3 |
| | | 2.2 |

Table 1 shown the sound reduction properties of the present invention.

Figure 10:
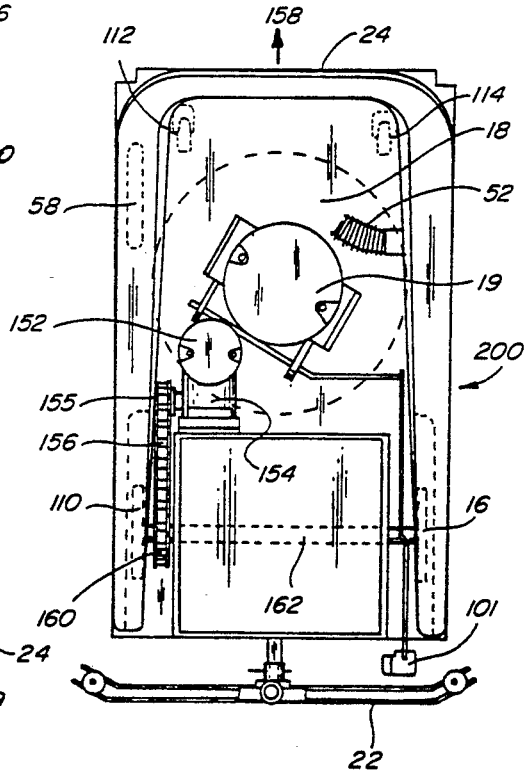
FIG. 10 is a section view of a floor cleaning machine with a traverse motor.

FIG. 10 shows an alternative embodiment of the self-propelled floor cleaning machine 10. The self propelled machine 200, shown in this Figure, is identical to the machine 10, except a traverse motor 152 has been added.

The traverse motors are typically 1/10 HP 24 volt D.C. These motors are low speed with high torque to drive the machine 200. However, other types of traverse motors may be applicable in this situation. The structure and function of the traverse motor 152 and the chain drive system are well known to those skilled in the art; however, it will be briefly described herein.

The traverse motor 152 is connected to a gear box 154 which connects to a shaft and drive sprocket 155. A chain 156 engages the sprocket 155 and provides torque to a rear sprocket 160. The rear sprocket 160 is driven by the chain 156. The rear sprocket 160 is connected to and drives the rear axle 162 causing the rear wheels 16 and 110 to rotate. The sound baffle 24 can be used on either the self propelled floor cleaning machine 200 or on the manual version 10.

While the foregoing is directed to the preferred embodiment of the present invention, other and further embodiments of the invention may be devised without departing from the basic scope thereof, and the scope thereof is determined by the claims which follow.

What is claimed:

1. A floor cleaning apparatus comprising:

a) a chassis with a plurality of wheels engaging the floor to support the floor cleaning apparatus and to permit it to be easily moved about on said floor;

b) means for scrubbing the floor including a circular disc positioned beneath said chassis and a brush motor mounted on the chassis to rotate said circular disc;

c) a solution tank for storage of cleaning solution;

d) a recovery tank for storage of dirty solution;

e) a hollow body mounted on the chassis, said body having an inlet and an outlet and an interior passageway allowing fluid communication between said inlet and said outlet, said body supporting the load of said solution tank and said recovery tank;

f) vacuum squeegee means to remove said dirty solution from the floor and transfer it to said recovery tank, including a vacuum motor; and g) means for connecting the outlet on said vacuum motor to the inlet of said body to direct the exhaust from said vacuum motor into said body and through said passageway to reduce noise as said exhaust exits said outlet of said body.

2. The apparatus of claim 1 wherein said hollow body is an elongated u-shaped member having said inlet positioned in one leg of the u and said outlet positioned in the opposing leg of the u.

3. The apparatus of claim 2 wherein said body is roto-molded from a thermoplastic as an integral piece.

4. The apparatus of claim 3 wherein said thermoplastic is HDPE.

5. The apparatus of claim 2 wherein the front of said hollow body is hinge mounted on said chassis allowing said body, said solution tank and said recovery tank to be tilted forward to facilitate access to said drive motor, and said vacuum motor.

6. The apparatus of claim 2 wherein the floor cleaning apparatus further includes a handle to be grasped by the operator to push the cleaning apparatus about said floor.

7. The apparatus of claim 2 further including traverse motor means to propel the cleaning apparatus about said floor.

8. The apparatus of claim 1 further including an aperture in said chassis sized and aligned to mate with said outlet in said body to vent said exhaust under said chassis.

9. The apparatus of claim 8 wherein said connecting means is a flexible tube.

10. The apparatus of claim 9 wherein said vacuum squeegee means includes a vacuum shoe positioned at the rear of the chassis and a flexible conduit running from said shoe to the inlet of said recovery tank to allow said dirty solution to be removed from the floor and transferred to the recovery tank.

11. The apparatus of claim 10 wherein said inlet of said recovery tank further includes an elongate tube vertically mounted inside said recovery tank and wherein the outlet of said recovery tank includes an elongate tube vertically mounted inside said recovery tank.

12. The apparatus of claim 11 wherein the suction side of said vacuum pump is connected to said outlet of said recovery tank and the pressure side of said vacuum pump is attached to said connecting means.

13. An integrated sound baffle for use in a floor cleaning machine having a chassis with brush motor mounted thereon, a solution tank, a recovery tank and a vacuum squeegee means including a vacuum motor and a shoe to remove dirty solution from the floor and transfer it to the recovery tank comprising:

a) a hollow elongate u-shaped body mounted on the chassis, said body having an inlet and an outlet and an interior passageway allowing fluid communication between said inlet and said outlet;

b) said inlet positioned on one leg of the u-shaped body and said outlet positioned on the opposing leg of said body; and c) said hollow elongated u-shaped body having a bottom surface in contact with the chassis and an upper surface supporting the load of the solution tank and the recovery tank.

14. The apparatus of claim 13 wherein said hollow, elongate u-shaped body is roto-molded from a thermoplastic.

15. The apparatus of claim 14 wherein said thermoplastic is HDPE.

16. The apparatus of claim 13 wherein the front of said hollow elongate u-shaped body is hinge mounted on said chassis allowing said body, the solution tank and the recovery tank to be tilted forward to facilitate access to the brush motor and the vacuum motor.

* * * * *